US005970601A

United States Patent [19]

Stilke et al.

[11] Patent Number: 5,970,601

[45] Date of Patent: Oct. 26, 1999

[54] COLLECTOR RING ARRANGEMENT, AND METHOD OF PRODUCING THE SAME

[75] Inventors: Henning Stilke, South Glamorgan, United Kingdom; Tanja Puhl, Pulan Pinany, Malaysia; Wolfgang Gottfried, Obersulm, Germany

[73] Assignee: Robert Bosch GmbH, Stuttgart, Germany

[21] Appl. No.: 08/786,434

[22] Filed: Jan. 21, 1997

[30] Foreign Application Priority Data

Jan. 31, 1996 [DE] Germany ..... 196 03 378

[51] Int. Cl.[6] ..... H01R 43/06

[52] U.S. Cl. ..... 29/597

[58] Field of Search ..... 29/597; 310/232, 310/219, 223, 224, 233, 234, 235, 236, 238, 239

[56] References Cited

U.S. PATENT DOCUMENTS

| | | | |
|---|---|---|---|
| 2,322,011 | 6/1943 | French | 310/232 |
| 4,180,300 | 12/1979 | Fort et al. . | |
| 4,403,164 | 9/1983 | Preece . | |

FOREIGN PATENT DOCUMENTS

| | | |
|---|---|---|
| 0094163 | 4/1983 | European Pat. Off. . |
| 0 094 163 | 11/1983 | European Pat. Off. . |
| 249 731 | 7/1912 | Germany . |
| 820 765 | 11/1951 | Germany . |
| 594 866 | 11/1947 | United Kingdom . |
| 2 045 541 | 10/1980 | United Kingdom . |
| 2 088 142 | 6/1982 | United Kingdom . |

*Primary Examiner*—Timothy V. Eley
*Assistant Examiner*—Benjamin M. Halpern
*Attorney, Agent, or Firm*—Michael J. Striker

[57] ABSTRACT

For producing a collector ring arrangement with a low radial thickness, a longitudinal portion of a shaft is coated with an insulating layer, than an electrically conductive layer is applied on the insulating layer, and the collector ring is fitted on the electrically conductive layer so as to be connected with the latter in an electrically conductive manner, for example by soldering. The length of the electrically conductive layer can be smaller than the length of the insulating layer. The process and the new collector ring arrangement reduce the material and time consumption during the manufacture and/or use the collector ring arrangement.

14 Claims, 2 Drawing Sheets

COLLECTOR RING ARRANGEMENT, AND METHOD OF PRODUCING THE SAME

BACKGROUND OF THE INVENTION

The present invention relates to a collector ring arrangement as well as to a method of producing the collector ring arrangement.

For supplying and withdrawing current to and from the rotor windings of an electrical machine, a collector ring arrangement is provided on the rotor shaft. Such collector ring arrangements in a prior art are composed of a synthetic plastic body which is pressed outside the bearings or between the bearings on the rotor shaft. The rotor shaft is reduced by a chip removing operation at this location during outer mounting, and the speed during chip removal must be adjusted to the stability which depends on the diameter. The collecting ring arrangement includes collecting rings which are correspondingly connected to the rotor winding through a current rail. Carbon brushes abut against the collecting rings for current transmission.

It is important to maintain the outer diameter of the collecting ring as small as possible. The smaller collecting ring in the outer diameter, the lower the peripheral speed of the grinding ring, and as the result the lower the surface temperature and the lower is the wear of the brushes. For this reason, it is conventional in the prior art to reduce the rotor shaft in a region in which it carries the collecting ring arrangement. It is therefore has been suggested to design the individual components, namely the synthetic plastic body, the current rails and the collector ring as thin as possible in their radial dimensions, to obtain an outer diameter of the total arrangement as small as possible. Such thin components are however to be mounted only with extreme caution, since they can be easily deformed. The reduction of the diameter of the shaft means a material expense for the working tools and the time expense for the reduction process, in particular in the end phase of the process, since with the reduced diameter the working speed because of lacking stability of the shaft must be throttled, or in other words the shaft is time-critical in the manufacture.

For reducing the radial thickness of the collector ring arrangement, it has been proposed in the European Patent Document EP-B 94 163 to produce the synthetic plastic body by injection molding, and during formation of the synthetic plastic body to incorporate the corresponding current rails and the collector ring in the synthetic plastic body. The thusly produced unit of synthetic plastic body and conductive elements is pressed onto the rotor shaft of the machine. The current rails require naturally a certain own rigidity, or in other words material thickness, and the synthetic plastic body must be correspondingly stable for mounting the unit on the shaft.

SUMMARY OF THE INVENTION

Accordingly, it is an object of the present invention to provide a collector ring arrangement which avoids the disadvantages of the prior art.

More particularly, it is an object of the present invention to provide a collector ring arrangement which is smaller in its radial thickness and nevertheless provides a reliable transmission of the voltage to a rotatable coil and maintains the electrical field.

It is also an object of the present invention to provide such a collector ring arrangement which simplifies the manufacturing process.

It is another object of the present invention to provide a method of producing the inventive collector ring arrangement.

In keeping with these objects and with others which will become apparent hereinafter, one feature of the present invention resides, briefly stated in a rotor for an electrical machine with a collector ring arrangement on a shaft with an insulating layer provided directly on the shaft, wherein via the insulating layer, an electrically conductive layer is provided, and a collector ring is arranged on the electrically conductive layer in contact with it, and the length of the electrically conductive layer is smaller than the length of the insulating layer.

In accordance with the inventive method of producing a collector ring arrangement on a rotor shaft of an electrical machine, in which a longitudinal portion of the shaft is coated with an insulating layer, the insulating layer is coated with an electrically conductive layer, on which a collector ring is fitted and electrically conductively connected for example by a soldering, wherein preferably the length of the electrically conductive layer is smaller than the length of the insulating layer.

The layers directly applied on the shaft can be very thin. The insulating layers are substantially thinner than the radial thickness of the synthetic plastic body, which are fitted on a shaft and therefore must be relatively stable. The electrically conductive layers can be much thinner than a current rail which must be mounted on the synthetic plastic body or cast in it during casting of the synthetic plastic body and requires for this process a certain own rigidity. With the inventive process, with the same wear or of the elements contributing to the transmission a thicker shaft pin can be used, whereby less material must be removed from the shaft. In other words, a lower material removal power of the tool is needed, and the shaft is time-non critical in the manufacturing process. On the other hand, a smaller collector ring diameter can be selected, whereby the service life of the collector ring arrangement and first of all of the carbon brushes is increased. The electrically conductive layer takes over the functions of the current trails, so that the time-consuming mounting of components can be dispensed with.

In the collector ring arrangement with several collector rings, alternatingly an insulating layer and an electrically conductive layer are applied. Therefore the same number of the electrically conductive layers and collector rings is available and a collector ring is mounted on each electrically conductive layer.

Preferably, in accordance with the inventive method the application of the layers can be performed by plasma spraying.

In accordance with a preferable embodiment, during mounting of each layer at least two regions of the previously applied layer, for example at its edges, is not covered, a collector ring is arranged on one region of each electrically conductive layer, while the other region operates as a contact field on which the current-conductive wire connected with the rotor winding is directly soldered.

Furthermore in accordance with a preferable embodiment, the edge portions of the layers can be formed for example with the use of a mask, so that expanded contact fields are produced on the electrically conductive layers. When these contact fields are offset relative to one another over the periphery of the coated shaft, the total length of the collector ring arrangement is reduced.

Aluminum carbonate is for example selected for the insulating layers, and copper is for example selected for the electrically conductive layers.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
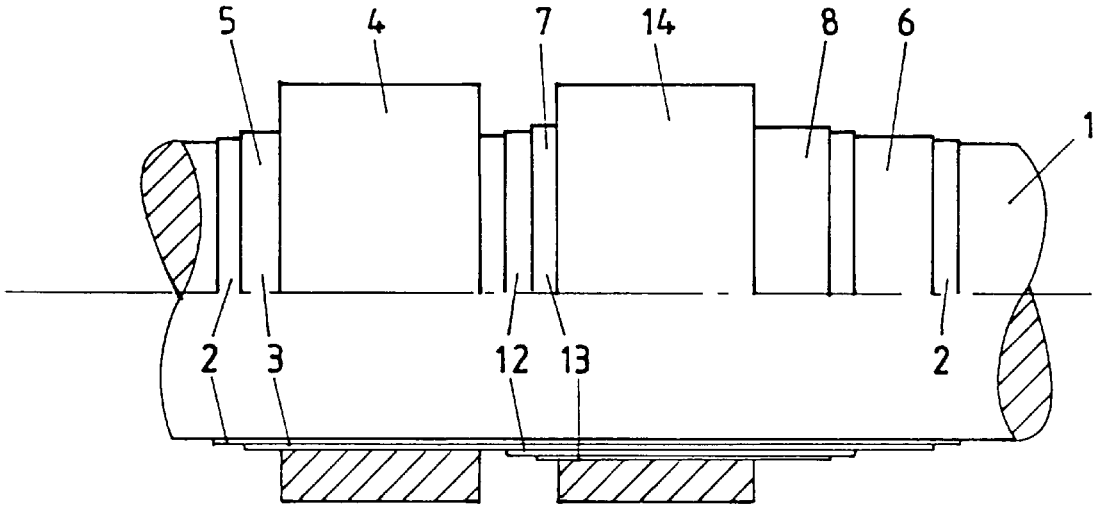
FIG. 1 is a view showing a longitudinal section of a rotor shaft of a collector ring arrangement of the present invention, with a side view shown in an upper part of the drawing and a longitudinal section shown in the lower part of the drawing.

As can be seen from FIG. 1, a rotor shaft which is identified as a whole with reference numeral 1 has an insulating layer 2, an electrically conductive layer 3 applied on the insulating layer, an insulating layer 12, and another electrically conductive layer 13 applied on it. Each of the applied layers 3, 12, 13 has a smaller length than that of the applied layers 2, 3, 12. The insulating layer 12 can have two regions 5 and 6 which are not covered by the electrically conductive layer 3 applied on the insulating layer 12. The collector ring 4 is arranged on it in the region 5 and soldered on the layer 5. The other region 6 operates as a contact field for a current-conductive wire which is connected with the rotor winding. The outermost electrically conductive layer 13 has a region 7 which carries the collector ring 14 and a region 8 which operates as a contact field for a current-conductive wire. They are not separated on their outer surface by an insulating material strip.

As can be seen from a sectional view in the lower half of FIG. 1, the insulating layer 2 and the electrically conductive layer 3 extend under both collector rings 4 and 14. In contrast, the insulating layer 12 and the electrically conductive layer 13 extend only under the collector ring 14. The electrically conductive layer 3 connects the collector ring 4 electrically with the contact field 6, while the electrically conductive layer 13 connects the collector ring 14 electrically with the contact field 8.

Figure 2:
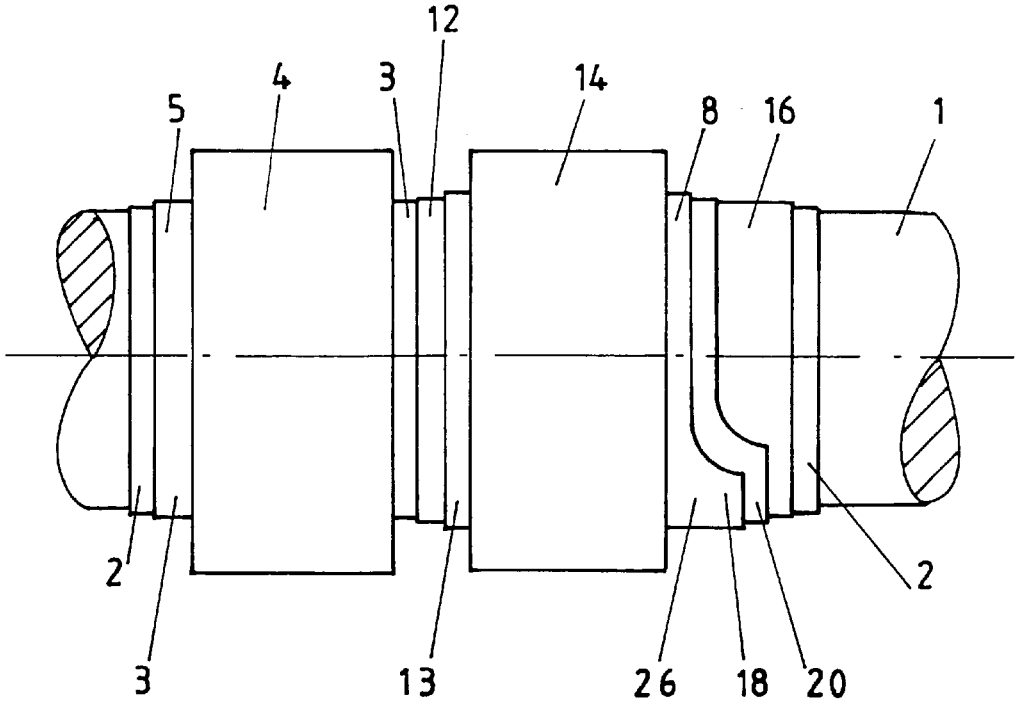
FIG. 2 is a view showing another embodiment of the inventive collector ring arrangement, with a longitudinal section of a rotor shaft and the collector ring arrangement on a side view.

FIG. 2 shows a similar construction. At the right end of the collector ring arrangement the end regions of the layers 12 and 13 are formed however in a special manner. The upper insulating layer 12 and the upper electrically conductive layer 13 which extend only under the collector ring 14, are provided with edge portions 18 and 20 at their end regions. These edge portions do not extend over the total periphery of the coated shaft 11. Thereby an expanded contact field 16 is formed on the electrically conductive layer 3, and an expanded contact field 26 is formed on the electrically conductive layer 8. As can be seen from the comparison of FIGS. 1 and 2, the variant of FIG. 2 shortens the total length of the collector ring arrangement, while the contact surface for the contact between the contact field and the current-conductive wire remains of the same size.

Figure 3:
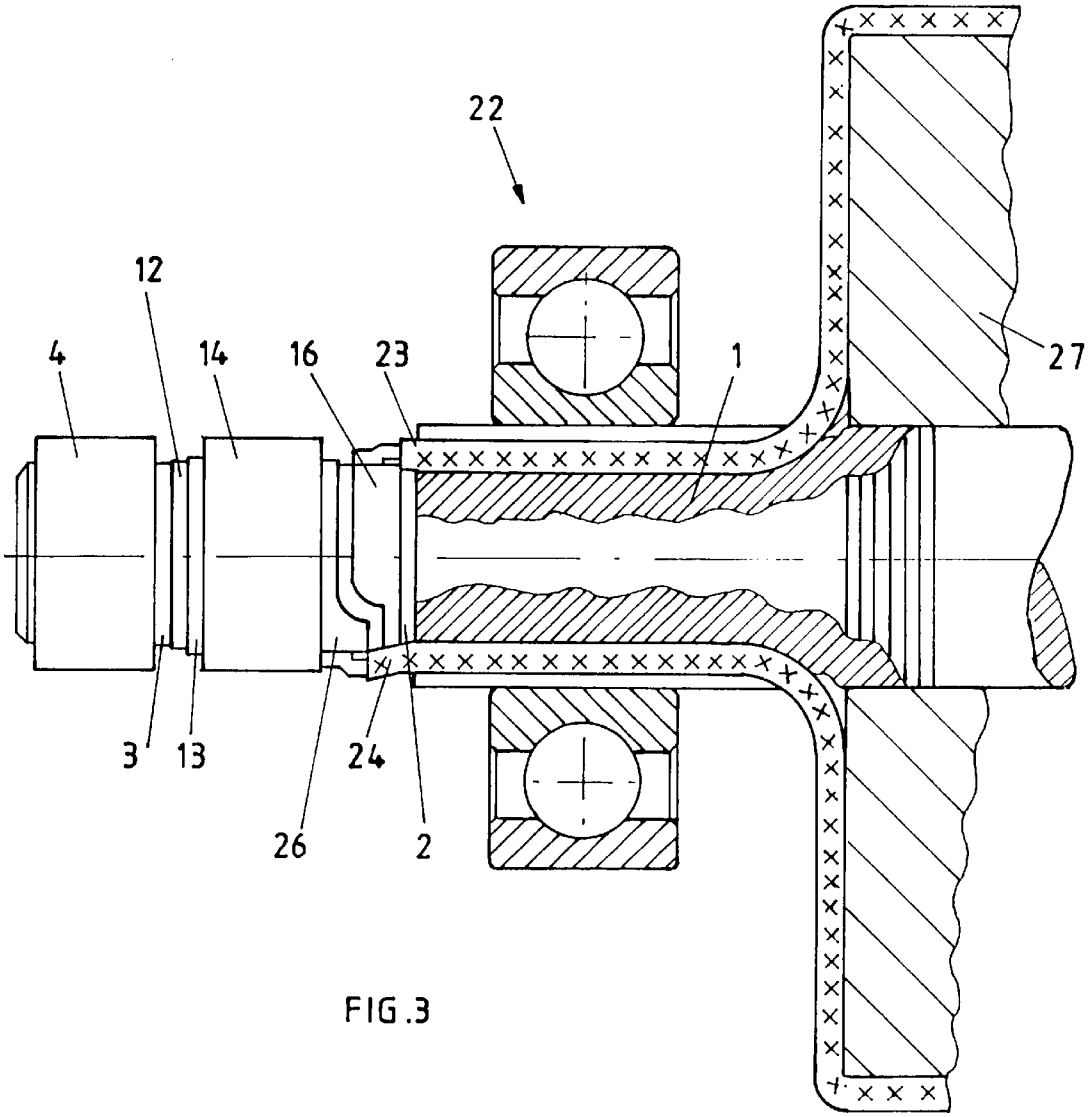
FIG. 3 is a partial view of a rotor in a longitudinal section, with the inventive collector ring arrangement on the rotor shaft.

FIG. 3 shows a part of a claw-pole rotor 27 of a three-phase generator with a bearing 22 and wires 23, 24 which connect the rotor winding with the collector rings 4, 14 of the collector ring arrangement. The collector ring arrangement corresponds to the arrangement of the embodiment of FIG. 2. In other words it has the asymmetrical design of the end regions of the layers 12 and 13 and therefore the expanded contact fields 16 and 26 for the contact with the wires 23 and 24.

It will be understood that each of the elements described above, or two or more together, may also find a useful application in other types of methods and constructions differing from the types described above.

While the invention has been illustrated and described as embodied in collector ring arrangement, and method of producing the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of producing a collector ring arrangement on a rotor shaft of an electric machine, comprising the steps of first coating a longitudinal portion of a shaft with an insulating layer so that a material of the insulating layer in substantially liquid state is directly applied on an outer surface of the shaft; then applying an electrically conductive layer in substantially liquid state on the insulating layer so that the electrically conductive layer forms a coating on the insulating layer; and thereafter fitting a collector ring on said electrically conductive layer in contact with said electrically conductive layer so as to electrically conductively connect the electrically conductive layer with the collector rings.

2. A method as defined in claim 1, wherein said applying includes applying the electrically conductive layer which has a length smaller than a length of said insulating layer.

3. A method as defined in claim 1, wherein said coating and applying includes coating and applying of a plurality of the insulating layers and the electrically conductive layers over one another in an alternating sequence so that at least each of the insulating layers has a smaller length than the corresponding electrically conductive layer, and the electrically conductive layer being provided with at least one free region for mounting a corresponding one of the collector rings on it.

4. A method as defined in claim 1, and further comprising retaining uncoated two regions of one of the layers which is applied on another of the layers; and fitting the collector rings on a region of the electrically conducting layer which is oriented toward a shaft end, while another region of the electrically conductive layer which is oriented toward the rotor is formed as a contact field.

5. A method as defined in claim 4, wherein the corresponding one of the layers remains uncoated in its edge regions.

6. A method as defined in claim 4, and further comprising applying the region of the electrically conductive layer which operates as a contact field in its edge portion over only a part of a periphery of the coated shaft so as to form an expanded contact field.

7. A method as defined in claim 4, and further comprising applying a region of the electrically conductive layer which operates as a contact field and an adjoining region of the insulating layer in its edge portions only over a part of a periphery of the coated shaft so as to provide an expanded contact field.

8. A method as defined in claim 6, wherein several expanded contact fields are formed so that they are arranged in an offset pattern over the periphery of the coated shaft.

9. A method as defined in claim 7, wherein several expanded contact fields are formed so that they are arranged in an offset pattern over the periphery of the coated shaft.

10. A method as defined in claim 1, wherein the insulating layer is composed of aluminum carbonate.

11. A method as defined in claim 1, wherein the electrically conductive layer is composed of copper.

12. A method of producing a collector ring arrangement on a rotor shaft of an electrical machine, comprising the steps of coating a longitudinal portion of a shaft with an insulating layer; applying an electrically conductive layer on the insulating layer; fitting a collector ring on said electrically conductive layer so as to electrically conductively connect the electrically conductive layer with the connector ring, the coating with the insulating layer and the application of the electrically conductive layer including plasma spraying of a corresponding layer.

13. A method of producing a collector ring arrangement on a rotor shaft of an electrical machine, comprising the steps of coating a longitudinal portion of a shaft with an insulating layer; applying an electrically conductive layer on the insulating layer; fitting a collector ring on said electrically conductive layer so as to electrically conductively connect the electrically conductive layer with the connector ring; retaining uncoated two regions of one of the layers which is applied on another of the layers; and fitting the collector ring on a region of the electrically conducting layer which is oriented toward a shaft end, while another region of the electrically conductive layer which is oriented toward the rotor is formed as a contact field; and applying the region of the electrically conductive layer which operates as a contact field in its edge portion over only a part of a periphery of the coated shaft so as to form an expanded contact field, the application of the region of the electrically conductive layer operating as a contact field being performed with the use of a mask.

14. A method of producing a collector ring arrangement on a rotor shaft of an electrical machine, comprising the steps of coating a longitudinal portion of a shaft with an insulating layer; applying an electrically conductive layer on the insulating layer; fitting a collector ring on said electrically conductive layer so as to electrically conductively connect the electrically conductive layer with the connector ring; retaining uncoated two regions of one of the layers which is applied on another of the layers; and fitting the collector ring on a region of the electrically conducting layer which is oriented toward a shaft end, while another region of the electrically conductive layer which is oriented toward the rotor is formed as a contact field; and applying a region of the electrically conductive layer which operates as a contact field and an adjoining region of the insulating layer in its edge portions only over a part of a periphery of the coated shaft so as to provide an expanded contact field, the application of the region of the electrically conductive layer operating as a contact field performed with the use of a mask.

* * * * *